US006609494B2

(12) United States Patent
Holtman

(10) Patent No.: US 6,609,494 B2
(45) Date of Patent: Aug. 26, 2003

(54) EMISSIONS CONTROLLER METHOD AND SYSTEM

(75) Inventor: Richard H. Holtman, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 112 days.

(21) Appl. No.: 09/882,690

(22) Filed: Jun. 15, 2001

(65) Prior Publication Data

US 2002/0189579 A1 Dec. 19, 2002

(51) Int. Cl.[7] ..... F02B 5/00
(52) U.S. Cl. ..... 123/305; 123/295
(58) Field of Search ..... 123/305, 295, 123/294, 472, 445, 478, 276; 239/533.1, 533.2, 533.4, 533.3

(56) References Cited

U.S. PATENT DOCUMENTS 4,473,046 A 9/1984 Aoyama et al.
4,633,830 A 1/1987 Oshima et al.
4,676,209 A 6/1987 Etoh et al.
4,685,432 A * 8/1987 Saito et al. ..... 123/276
5,941,207 A * 8/1999 Anderson et al. ..... 123/295
6,045,063 A * 4/2000 Koike et al. ..... 239/533.3

OTHER PUBLICATIONS

John B. Heywood, Internal Combustion Engine Fundamentals, 1988, pp. 522–532.

* cited by examiner

*Primary Examiner*—Mahmoud Gimie
(74) *Attorney, Agent, or Firm*—Mike Huber; Al Hickman

(57) ABSTRACT

The present invention provides a method and system to control emissions in an engine by controlling spray plume characteristics, such as length and angle. Specifically, a system implementing the present invention includes an fuel injector, an engine cylinder and an electronic control module (ECM). The ECM determines spray plume parameters, including time from start of injection, nozzle hole diameter, pressure differential between the cylinder and fuel in the fuel injector nozzle, and gas temperature and density in the cylinder. Upon determining the spray plume parameters, the ECM calculates the spray plume characteristics and compares them to the optimal spray plume characteristics. The ECM then proceeds to adjust fuel injection characteristics, such as injection on time, rail pressure, and injection timing relative to piston position, to optimize the spray plume.

19 Claims, 2 Drawing Sheets

EMISSIONS CONTROLLER METHOD AND SYSTEM

TECHNICAL FIELD

The present invention relates to a method and system for controlling smoke emissions in a engine and specifically controlling spray plume characteristics.

BACKGROUND

Engine emissions control is very important in today's environmentally conscience society. Regulations have continually reduced the amount of allowable emissions, forcing engine manufacturers to find new ways of controlling the combustion process.

One area that has received considerable attention is the fuel injection process and its impact on combustion. A fuel injector injects pressurized fuel into the cylinder. In order to optimize the combustion process, it is desirable to atomize the fuel as much as possible, thereby reducing emissions. In order to properly atomize the fuel, it is necessary to expose the spray plume to as much area (combustion air) as possible; however control of plume size is necessary. If the spray plume is too large, such that the spray contacts the cylinder walls or piston, combustion is negatively affected and emissions are increased. Further, if the spray is too small, insufficient atomization can not occur, thereby preventing complete combustion and increasing emissions.

The prior art has attempted to control emissions related to fuel injection with timing, injector angles, swirl chambers, and other fixed designs. However, these approaches do not address the fact that the conditions affecting spray plume characteristics, such as length and angle, change with operating conditions. For example, the parameters that exist during cold start are noticeably different from the parameters that exist during hot running. The present invention is directed to overcoming one or more of the problems identified above.

SUMMARY OF THE INVENTION

The present invention provides a method and system of reducing emissions from an engine. The method comprises determining spray plume parameters, calculating fuel injection spray plume characteristics, comparing the spray plume characteristics to predetermined spray plume characteristics and adjusting at least one fuel injection characteristic in response to the comparison in order to change the spray plume characteristics closer to the predetermined spray plume characteristics. The system includes a combustion chamber, a fuel injector, means to determine spray plume parameters, and an electronic control module to calculate and adjust spray plume characteristics.

DETAILED DESCRIPTION

Figure 1:
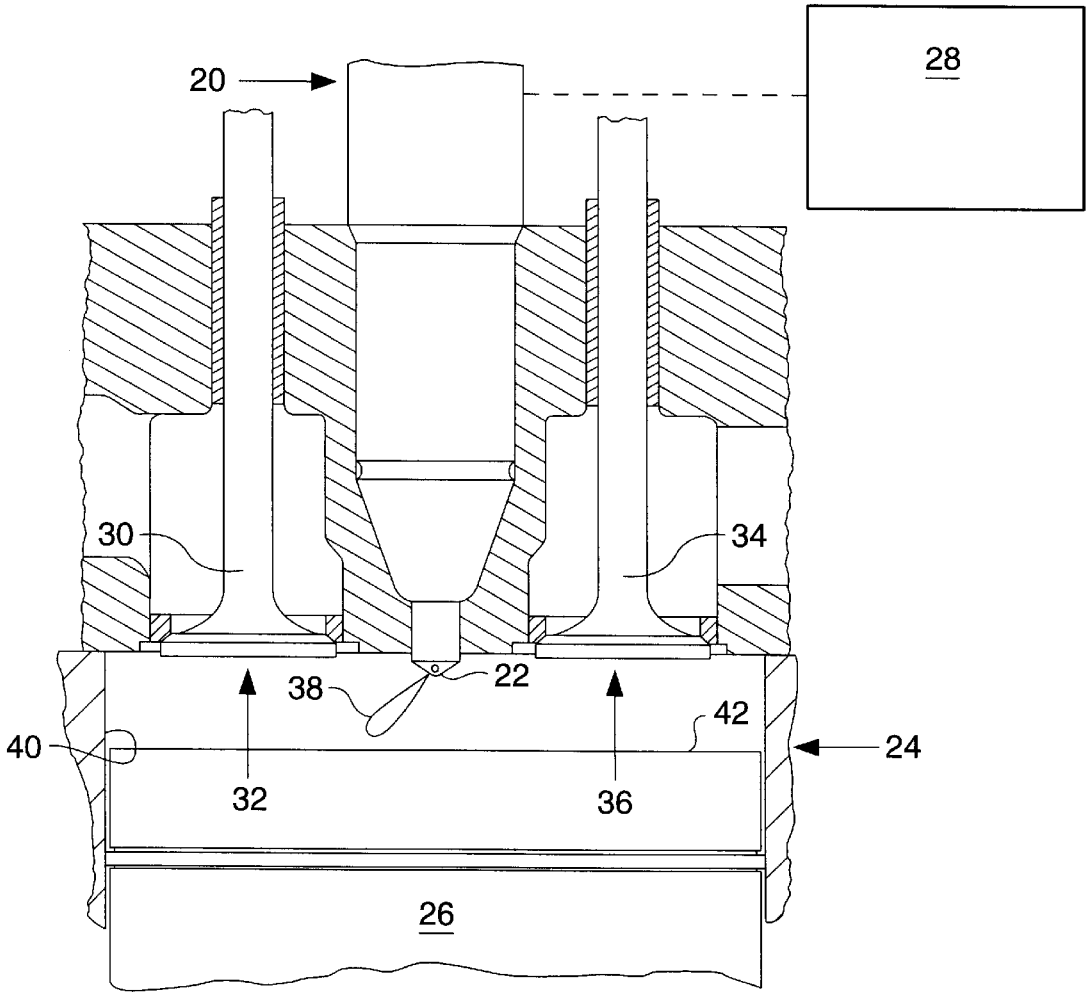
FIG. 1 illustrates an exemplary engine system with which the present invention may be used.

The present invention provides a method and system for controlling smoke emissions, specifically by controlling fuel injection spray plume characteristics, such as length and angle. FIG. 1 illustrates a general engine system, in which the present invention could be implemented, comprising a fuel injector 20, a cylinder 24, and an electronic control module (ECM) 28. The fuel injector 20 includes a nozzle 22 from which fuel, in the form of at least one spray plume 38, is injected into the cylinder 24 through at least one orifice (not shown). It is desirable that the spray plume 38 be an optimal size, allowing maximum atomization, without coming in contact with the cylinder wall 40 or piston head 26. It should be noted that the present invention could apply to a variety of fuel injection systems, including common rail, electronic unit injectors, and hydraulically actuated electronically controlled unit injectors.

The cylinder includes at least one intake port 32 and at least one exhaust port 36, which are selectively opened and closed by corresponding intake valve 30 and exhaust valve 34. Piston 26 is located within the combustion chamber or cylinder 24 to compress air for combustion. The ECM 28 can monitor various system parameters, such as rail pressure (in a low or high pressure system), component and fluid temperatures (such as gas temperature in the combustion chamber), etc and subsequently control various aspects of the fuel injection and combustion process, such as injection timing, injection duration, valve opening/closing, rail pressure etc. It should be noted that FIG. 1 only shows the ECM 28 "connected" to the injector but the ECM 28 is actually electronically connected to numerous systems and components. For example, the ECM 28 could be connected to sensors in the cylinder or common rail for determining various parameters. The numerous types of "connections" necessary for monitoring and control of an engine and fuel injection are well known in the art and need not be explained in detail here.

Figure 2:
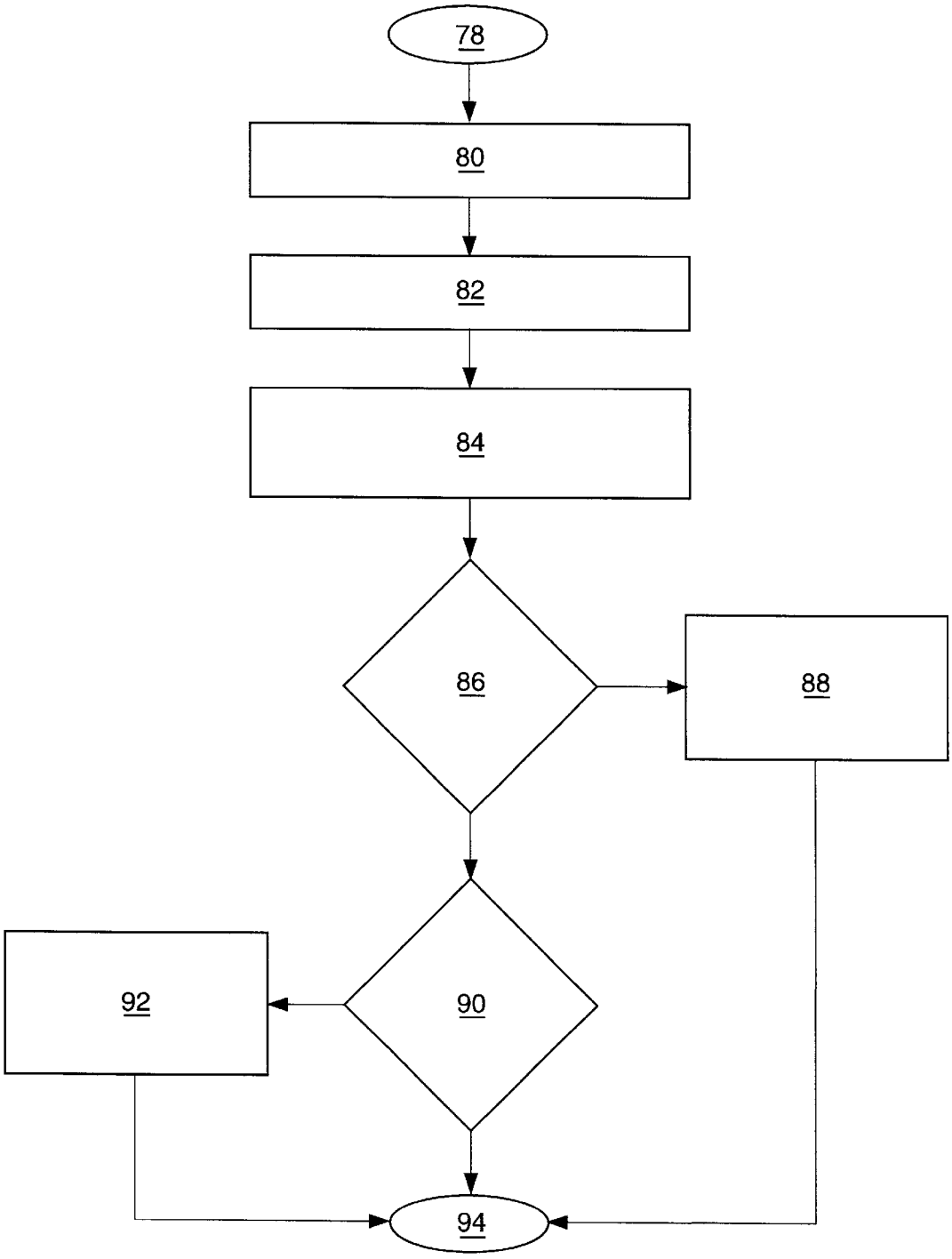
FIG. 2 is a flow chart illustrating the method of controlling spray plume characteristics according to the present invention.

The present invention relates to controlling spray plume characteristics. FIG. 2 illustrates a flow chart for the present invention. The Flowchart begins at 78. At 80, the ECM 28 must determine several spray plume parameters. These include injection time, nozzle hole diameter, the pressure differential between the cylinder and the fuel in the nozzle, the gas density in the cylinder, the temperature of the fuel, and liquid density of the fuel. The means to determine the above parameters are well known in the art but could include appropriate sensors directly monitoring the described parameters or measuring related parameters and then inferring the other necessary parameters. Further, some of the above parameters, such as nozzle hole diameter, are constants and can be programmed in to the ECM at the time of production.

Next, at 82, the spray plume characteristics are determined. For example, the spray plume length can be calculated using the spray penetration equation:

$$s=3.07(\Delta p/\rho_g)^{1/4}(td_n)^{1/2}(294/T_g)^{1/4}$$

where

- t=time from start of injection in seconds (injection duration)
- s=plume length in meters
- $d_n$=nozzle hole diameter in meters
- $\Delta p$=pressure differential between the combustion chamber and fuel in the fuel injector nozzle in pascals
- $\rho_g$=gas density in the combustion chamber in kilograms per cubic meter
- $T_g$=gas temperature in the combustion chamber in Kelvins.

The spray plume angle can be calculated using the spray plume angle equation:

$$\tan \Theta/2=(1/A)4\Pi(\rho_g/\rho_l)^{1/2}((\sqrt{3})/6)$$

where $\Theta$=the angle of the spray plume $A=3.0+0.28(L_n/D_n)$ where $L_n$=length of the orifice in the nozzle in meters $D_n$=diameter of the orifice in the nozzle in meters $\rho_g$=gas density in the combustion chamber in kilograms per cubic meter $\rho_l$=liquid density of the fuel in kilograms per cubic meter (It should be noted that the above equations are not meant to be the only equations that can be used; other equations and variations of the above equations may also provide the relevant spray plume characteristics. For example, depending the type of system, the above equations may need to be modified to account for swirl in the combustion chamber.)

At 84, the ECM 28 then compares the spray plume characteristics with the optimal spray plume characteristics. For example, the optimal spray plume length for given operating conditions can be a predetermined distance, developed during injector/cylinder design or can be varied by ECM 28, based upon measured parameters and the type of injection. It should be noted that depending upon desired objectives, the ECM 28 could also compare the spray plume length to distances between the nozzle 22 and the cylinder wall 40 or the nozzle 22 and the piston head 42. These additional comparisons normally would not be necessary because the optimal spray plume length should take these distances in to account; however, the present invention has the ability to control spray plume length in a variety of manners. One could choose to not have an optimal spray plume length and just control the spray plume so that it does not contact any surfaces, such as the cylinder wall 40 or piston head 42. Further comparisons can also be performed in a similar manner, such as comparing the calculated spray plume angle to a predetermined angle.

At 86, the ECM 28 begins to optimize the spray plume characteristics. First, the ECM determines if the spray plume characteristics are greater than optimal. If so, the appropriate fuel injection characteristics are adjusted at 88 to reduce the spray plume characteristics. For example, if the spray plume length was too long, the ECM could modify injection duration, rail pressure, or timing of injection relative to piston position to reduce the length. If the spray plume characteristics are not greater than optimal, then the method proceeds to step 90 to determine if the spray plume characteristics are less than optimal. If so, step 92 adjusts the appropriate fuel characteristics to increase spray plume characteristics. If the spray plume characteristics are not less than optimal then the spray plume characteristics are optimal and no adjustments need to be made and the flowchart ends at 94.

Industrial Applicability

By controlling spray plume characteristics, smoke emissions are better controlled. This results from several factors. First, an optimal spray plume helps the fuel atomize as much as possible, which insures a more complete burning of the injected fuel. Second, control of the spray plume prevents fuel from coming in to contract with the cylinder wall or piston head, thereby avoiding unnecessary emissions. Generally, when fuel is sprayed on to the cylinder wall or piston head additional smoke is created during combustion, increasing emissions.

The present invention also provides a substantial improvement over the prior art by providing a method and system capable of controlling spray plume characteristics not only on the test bench in order to optimize design, but also in actual operation. The present invention allows the spray plume characteristics to be controlled during operation, as governing parameters change. For example, during cold start the temperature is low and the density of the gas in the cylinder is high; however, after the engine has been running for an extended period of time, the temperature will increase and the density will decrease. The ECM 28 can monitor these conditions and make necessary changes to optimize the spray plume characteristics and reduce emissions, such as limit injection duration or decrease rail pressure. Then as the temperature and density increase the ECM can respond accordingly and change the fuel injection characteristics as needed to maintain optimal operation.

The above description is intended for illustrative purposes only, and is not intended to limit the scope of the present invention in any way. Thus, those skilled in the art will appreciate that various modifications can be made to the illustrated embodiment without departing from the spirit and scope of the present invention. Other aspects, features, and advantages of the present invention may be obtained from a study of this disclosure and the drawings, along with the appended claims.

What is claimed is:

1. A method of controlling a spray plume delivered from a fuel nozzle during operation of an internal combustion engine, comprising the steps of:

determining an engine operating parameter;

determining an actual fuel injection spray plume characteristic based on said engine operating parameter;

determining an optimal fuel injection spray plume characteristic;

comparing said actual fuel injection spray plume characteristic to said optimal fuel injection spray plume characteristic; and modifying said actual fuel injection spray plume characteristic as a function of said optimal fuel injection spray plume characteristic.

2. The method of claim 1, wherein said actual and optimal fuel injection spray plume characteristic includes at least one of an angle and length of a fuel injection spray plume.

3. The method of claim 2, including the step of calculating a length of said fuel injection spray plume.

4. The method of claim 3, wherein the step of calculating the length of said fuel injection spray plume includes the step of using a predetermined spray penetration equation.

5. The method of claim 1, wherein said step of determining the engine operating parameter includes the step of determining a fuel injection duration.

6. The method of claim 1 wherein said step of determining the engine operating parameter includes the step of determining a fluid pressure.

7. The method of claim 1 wherein said step of determining the engine operating parameter includes the step of determining a fuel injection timing.

8. The method of claim 1 wherein said step of determining the actual fuel injection spray plume characteristic includes the step of determining one or more engine operating parameters selected from at least one of a time from a start of injection, a nozzle hole diameter, a pressure in a combustion chamber, a fuel pressure in an injector nozzle, a gas density in said combustion chamber, and a gas temperature in said combustion chamber.

9. The method of claim 2, including the step of calculating an angle of the fuel injection spray plume.

10. The method of claim 9, wherein said step of calculating the angle of said fuel injection spray plume includes the step of calculating the length of said fuel injection spray plume using a predetermined spray plume angle equation.

11. The method of claim 9, wherein said step of determining the actual fuel injection spray plume characteristic includes the step of determining one or more engine operating parameters based on at least one of a gas density in a combustion chamber, a liquid density of a fuel, a length of a nozzle, and a nozzle hole diameter.

12. The method of claim 1, wherein said step of determining the optimal spray plume characteristic includes the step of determining an optimal spray plume length.

13. The method of claim 12, wherein said step of determining the optimal spray plume length includes the step of determining a minimum distance from the fuel nozzle to a surface of a combustion chamber.

14. The method of claim 13, further comprising the step of setting said optimal spray plume to a length less than said minimum distance.

15. A system for controlling a spray plume of a fuel nozzle in an internal combustion engine during an operation of said internal combustion engine, comprising:

a combustion chamber;

a fuel nozzle disposed in said combustion chamber;

a sensor connected to sense an engine operating parameter and deliver a responsive engine operating parameter signal; and an electronic control module connected to said sensor and being adapted to receive said engine operating parameter signal, said electronic control module determining an actual fuel injection spray plume characteristic, comparing said actual fuel injection spray plume characteristic to an optimal fuel injection spray plume characteristic and delivering a modified spray plume characteristic control signal to change said engine operating parameter.

16. The system of claim 15 wherein said engine operating parameter includes at least one of an injection duration, a fluid pressure, and an injection timing relative to piston position.

17. The system of claim 15 wherein said fuel injection spray plume characteristic includes a spray plume length.

18. The system of claim 15 wherein said fuel injection spray plume characteristic includes a spray plume angle.

19. The system of claim 15 wherein said fuel injection spray characteristic includes a spray plume length and a spray plume angle.

* * * * *